United States Patent [19]

Hartley et al.

[11] 4,233,902

[45] Nov. 18, 1980

[54] 76MM RAMMABLE PRACTICE CARTRIDGE

[75] Inventors: Frederick Hartley, King George; Keith Slocum, Colonial Beach; John Newquist; Nicholas Moga, both of Fredericksburg, all of Va.

[73] Assignee: The United States of America as represented by the Secretary of the Navy, Washington, D.C.

[21] Appl. No.: 963,605

[22] Filed: Nov. 24, 1978

[51] Int. Cl.[3] ..... F42B 5/22; F42B 13/20

[52] U.S. Cl. ..... 102/41; 102/92.7

[58] Field of Search ..... 102/41, 92.7

[56] References Cited

U.S. PATENT DOCUMENTS

| | | | |
|---|---|---|---|
| 759,516 | 5/1904 | Guye | 102/41 |
| 3,016,832 | 1/1962 | Carlson | 102/41 |
| 3,027,840 | 4/1962 | Hannas et al. | 102/41 |
| 3,141,246 | 7/1964 | Boris | 102/41 X |
| 3,848,350 | 11/1974 | Seminiano | 102/41 X |
| 4,109,579 | 8/1978 | Carter | 102/41 |

FOREIGN PATENT DOCUMENTS

| | | | |
|---|---|---|---|
| 331273 | 1/1921 | Fed. Rep. of Germany | 102/41 |

*Primary Examiner*—Richard D. Lovering

[57] ABSTRACT

An inert, reuseable cartridge which is fully compatable with the cycling and ramming operations of an automatic gun mount comprising a cartridge case having an inert projectile and dummy fuze welded thereto. A sliding mass is disposed within the cartridge case and coupled to an adjustable shock absorber which dissipates the energy of the sliding mass during ramming to duplicate the unique rebound response of an in-service projectile. The exterior dimensions, center of gravity, and total mass properties are equivalent to those of the in-service cartridge.

7 Claims, 5 Drawing Figures

76MM RAMMABLE PRACTICE CARTRIDGE

BACKGROUND OF THE INVENTION

The 76 mm MK 75 MOD O/1 gun mount is fully automatic and capable of rapid fire. The gun mount includes mechanisms for hoisting cartridges vertically from the magazine, rotating the cartridges to a horizontal position and depositing them in a ramming tray, and then ramming the cartridges into the gun. In order to isolate problems and facilitate corrective maintenance when malfunctions of the gun mount occur, the 76 mm MK 168 MOD O cartridge was developed. This cartridge includes a propellant charge and a BL&P (blind loaded and plugged) projectile. That is, the projectile is loaded with an inert load and capped with a plug simulating the fuze. The load and dummy fuze are sized to duplicate the mass characteristics of an inservice projectile.

The 76 mm MK 168 MOD O cartridge just described is fully compatible with the cycling and ramming operations of the 76 mm MK 75 MOD O/1 gun mount. However, to achieve this compatability, the BL&P projectile body must separate from the propellant charge and seat in the forcing cone of the gun tube liner during ramming. Normally, the BL&P projectile is extracted by gun firing since there is no easy way of extracting a projectile through the breech once the projectile is seated in the forcing cone. This cartridge is not reuseable and requires expenditure of ammunition. Also, while this cartridge may be utilized at sea to test the cycling and ramming operations of the gun mount since the BL&P projectile could be extracted by gun firing, this cartridge obviously could not be used when the ship is in port, where better service facilities are available, due to the need to extract the projectile by gun firing.

A one piece dummy cartridge (MK 197 MOD O) has also been made and can be used to test the various cycling operations of the mount up to, but not including, the ramming operation. The one-piece dummy cartridge would rebound too rapidly during the ramming operation and interfere with movement of the sliding breech block. The ramming operation requires a unique rebound response for proper functioning and this response is not obtainable with a one-piece dummy cartridge.

SUMMARY OF THE INVENTION

The aforementioned difficulties are obviated by the present invention which comprises a cartridge case having a projectile body welded and crimped thereto and a dummy fuze fixed to the nose of the projectile. The cartridge contains a sliding mass connected to an adjustable shock absorber for dissipating the energy of the sliding mass which continues moving forward when the flange at the base of the cartridge contacts the breech face during ramming. The continued forward movement of the sliding mass tends to preclude rebounding of the cartridge and simulates the effect of separation of an in-service projectile at the points where the cartridge case is crimped into grooves in the rotating band of the projectile. Access holes are provided and interior dimensions are sized to allow adjustments to the shock absorber. A compression spring is used to return the sliding mass to its original position.

STATEMENT OF THE OBJECTS OF THE INVENTION

It is a primary object of this invention to provide an inert or dummy cartridge which is fully compatible with the cycling and ramming operation of automatic gun mounts.

It is another object of this invention to provide a dummy cartridge which is reuseable.

It is a further object of this invention to provide an inert cartridge which will duplicate the unique rebound response of inservice ammunition.

BRIEF DESCRIPTION OF THE DRAWINGS

Other objects, advantages and novel features of the present invention will become readily apparent upon consideration of the following detailed description when read in conjunction with the accompanying drawings wherein.

DESCRIPTION OF THE PREFERRED EMBODIMENT

Figure 1:
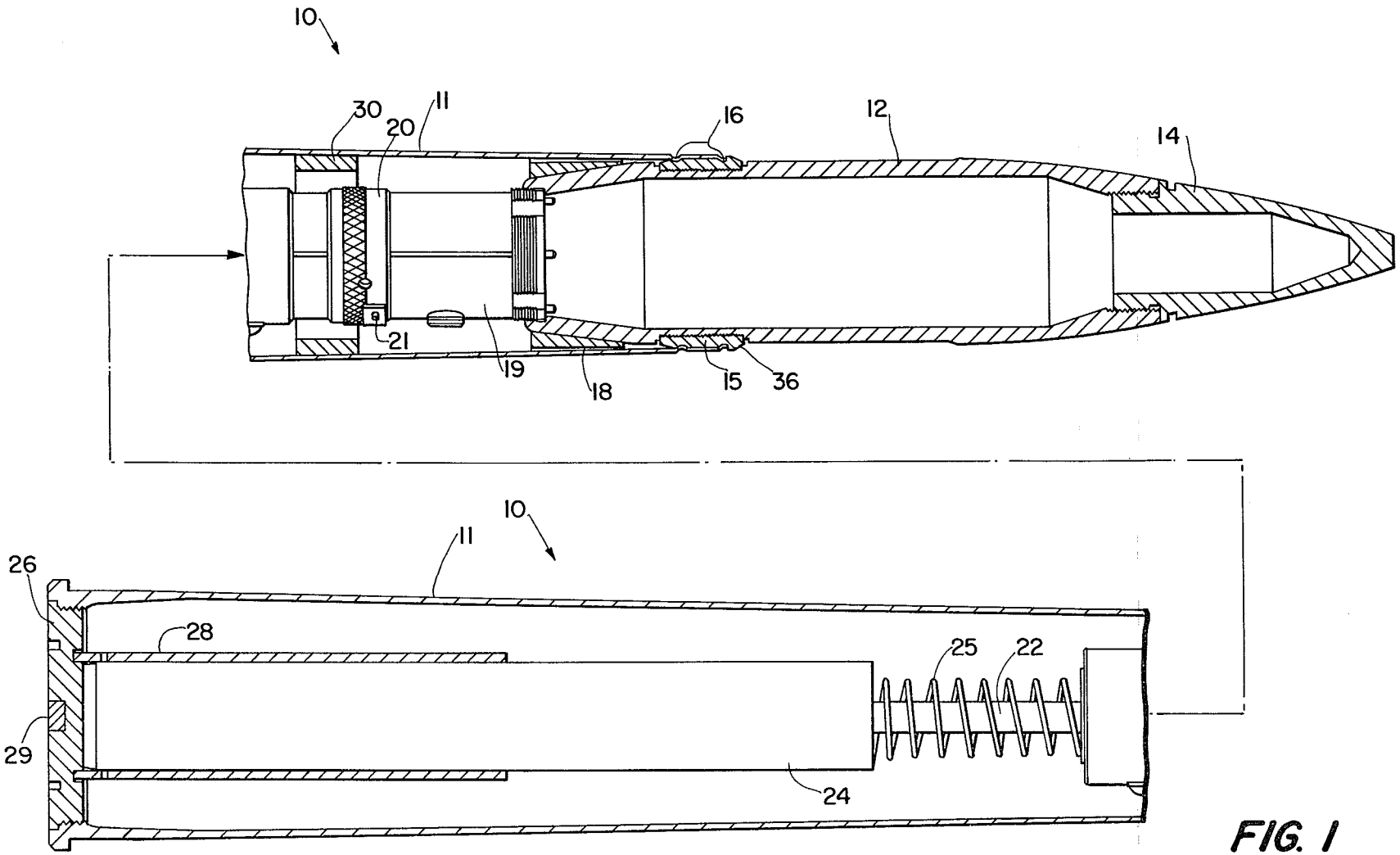
FIG. 1 is a sectional view of an inert cartridge embodying and illustrating the principal features of the invention.

Attention now is directed to the drawings, wherein like numerals of reference designate like parts throughout the several views, and more particularly to FIG. 1 wherein there is disclosed an inert or dummy cartridge designated generally by the reference numeral 10. The cartridge 10 comprises a cartridge case 11, a projectile body 12 and an inert dummy fuze 14. The projectile body 12 is provided with the usual rotating and obturating band 15 and the cartridge case 11 is crimped at 16 into grooves formed in the rotating band 15 in the same manner as an in-service cartridge. The projectile body 12 is also welded at 18 to the cartridge case 11 since repeated use of the dummy cartridge 10 will loosen the projectile body if it is held only by crimps 16. The weld 18, of course, is not present in an in-service cartridge.

An adjustable hydraulic shock absorber 19 is threaded into the projectile body 12. A knurled ring 20 is provided for adjustment by rotation thereof of the shock absorber 19 and a set screw 21 is used to lock the ring 20 in place when the proper adjustment has been obtained. The interior details of the shock absorber adjustment are not shown since various different types of shock absorbers, both hydraulic and non-hydraulic, may be used as long as they are adjustable and have the appropriate capacity. Determination of the proper adjustment is made analytically and will be described later. Access holes (not shown) are provided in the cartridge case 11 to facilitate adjustment of the shock absorber 19.

The shock absorber 19 has a shaft or piston 22 projecting from the rearward end thereof and a sliding mass 24 is fixed to the shaft 22. A weak compression spring 25 is interposed between the shock absorber 19 and the mass 24 and serves to return the mass 24 to its initial position after extraction of the dummy cartridge from the gun. A base plate 26 closes the rearward end of the cartridge case 11 and mounts a guide tube 28 which encompasses and positions the sliding mass 24. An insert 29, of nylon or other soft material, is provided in the base plate 26 to preclude damage to the firing pin of the gun. A reinforcing ring 30 is provided within the cartridge case 11 at a point where the ammunition handling mechanism grips the cartridge to preclude damage to the case 11 through repeated cycling.

Figure 2A:
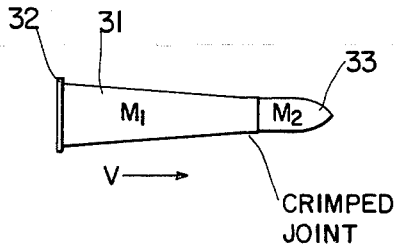
FIGS. 2*a* and 2*b* are a schematic representation of the ramming cycle of a typical in-service cartridge.
Figure 2B:
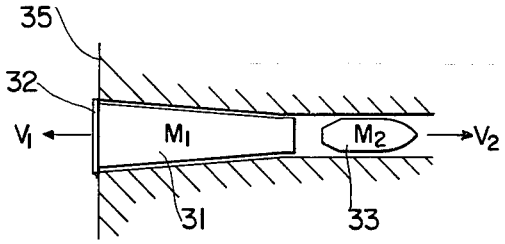

Attention now is directed to FIGS. 2*a* and 2*b* for an analytical description of the ramming cycle using an in-service cartridge such as the MK 165 MOD O or MK 166 MOD O high explosive rounds. The in-service cartridge comprises a cartridge case 31 including a propellant charge, and a projectile 33 crimped thereto. The cartridge is rammed into the gun tube until a flange 32 on the cartridge case 31 engages the face of the breech block 35. At this time the case 31 and projectile 33 begin to separate at the crimped joint such as that illustrated at 16 (FIG. 1). The projectile 33 moves forward until a shoulder (36 in FIG. 1) on the rotating band engages the forcing cone of the gun tube. The cartridge case 31 and projectile 33 are shown completely separated in FIG. 2*b* for purposes of clarity in analysis although they do not in fact completely separate. The in-service projectile moves forward approximately 1 centimeter before the rotating band wedges in the forcing cone.

Considering now the elements shown in FIGS. 2*a* and 2*b*, if:

$M_1$ = propelling charge mass $M_2$ = projectile body mass $V$ = Initial ram velocity of cartridge $V_1$ = rebound velocity of propelling charge $V_2$ = residual velocity of projectile body after separation $W$ = Energy dissipated due to inelastic nature of collision, separation at the crimped joint, sliding friction, etc.

Then, the energy balance is:

$$\tfrac{1}{2}V^2(M_1+M_2)=W+\tfrac{1}{2}(M_1V_1^2+M_2V_2^2)$$

and the rebound energy of the propelling charge is then:

$$\tfrac{1}{2}M_1V_1^2=\tfrac{1}{2}[V^2(M_1+M_2)-M_2V_2^2]-W$$

Figure 3A:
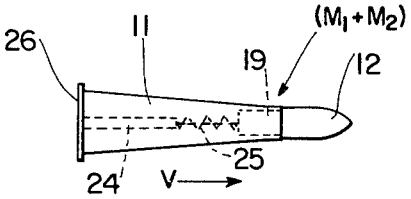
FIGS. 3*a* and 3*b* are a schematic representation of the ramming cycle of the inert or dummy cartridge of the present invention.
Figure 3B:
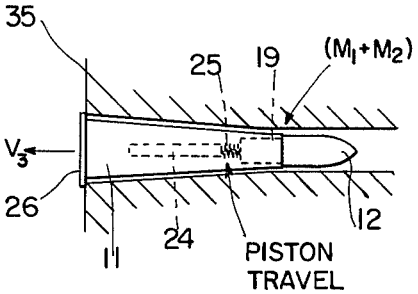

Referring now to FIGS. 3*a* and 3*b* there is schematically illustrated a ramming cycle for the dummy cartridge of the present invention. Considering the elements shown in FIGS. 3*a* and 3*b* if:

$V_3$ = rebound velocity of cartridge $W_1$ = energy dissipated due to inelastic nature of the collision, energy converted into heat by the shock absorber, sliding friction, etc.

Then, the energy balance is:

$$\tfrac{1}{2}V^2(M_1+M_2)=W+\tfrac{1}{2}V_3^2(M_1+M_2)$$

and the rebound energy of the cartridge is then:

$$\tfrac{1}{2}V_3^2(M_1+M_2)=\tfrac{1}{2}V^2(M_1+M_2)-W_1$$

The rebound energy of the rammable dummy cartridge should be less than or equal to that of a typical in-service cartridge which requires that:

$$\tfrac{1}{2}[V^2(M_1+M_2)-M_2V_2^2]-W\geqq\tfrac{1}{2}V^2(M_1+M_2)-W_1$$

which reduces to:

$$W_1\geqq W+\tfrac{1}{2}M_2V_2^2$$

This last equation defines, in general terms, the requirements of the rammable dummy cartridge design and was used in determining the exterior dimensions, center of gravity and total mass properties of the present invention in order to duplicate the unique rebound response of an in-service projectile.

OPERATION

The rammable dummy cartridge 10 is cycled and rammed in the identical manner as in-service cartridges. During the ramming operation the entire cartridge is slammed into the gun tube liner so that the flange 32 collides with the breech face 35. The sliding mass 24 continues its forward motion driving the shaft or shock absorber piston 22 into the shock absorber 19. Oil flow within the shock absorber dissipates the momentum of the sliding mass and converts its energy due to motion into heat. The energy converted in this manner is controlled, by adjustment of the shock absorber 19, so that the energy due to the motion of the rebounding system is less than or equal to that of the rebounding propellant charge of in-service cartridges. The rammable dummy cartridge 10 is extracted from the gun after the ramming operation and is reuseable.

CONCLUSION

From the foregoing it will be readily apparent that the present invention provides numerous advantages not found in prior art devices. For example, it replaces a combination of in-service propellant cases with BL&P projectiles since the BL&P cartridge cannot be completely extracted from the gun by normal and conventional methods but must be gunfired and hence is not reuseable. It also replaces the one-piece dummy cartridge which cannot be used to test the ramming operation because the energy of the rebounding mass is excessive. And finally, it provides a reuseable dummy cartridge which may be cycled through all the operations of an automatic gun mount which will enable service technicians to rapidly pinpoint any malfunctioning components.

Obviously many modifications and variations of the present invention are possible in the light of the above teachings and are such as would readily occur to those skilled in the art. For example, the translational kinetic energy of the sliding mass could also be converted into potential energy (instead of heat) by the utilization of a spring which would be allowed to compress but would have stops to prevent it from returning until released manually. Additionally, the translational kinetic energy of the sliding mass could also be converted into rotational kinetic energy by utilizing a rifled or screw thread fixture to impart angular motion either to the sliding mass or to another mass. It is therefore to be understood that within the scope of the appended claims the invention may be practiced otherwise than as specifically described.

What is claimed is:

1. An inert dummy cartridge adapted to be repeatedly cycled through automatic gun mounts and capable of simulating the mass, rebound and velocity characteristics of live rounds during ramming comprising:

a cartridge case having a flange on the base thereof;

a projectile body fixed in the open end of said cartridge case and including a dummy fuze, said projectile body and fuze having the same mass and center of gravity as the projectile in a live round;

a shock absorber disposed within said cartridge case and fixed to the base of said projectile body, said shock absorber having a piston projecting rearwardly thereof; and a mass slidably disposed for axial movement within said cartridge case and fixed to the piston of said shock absorber, said sliding mass being adapted to continue moving forward during the ramming cycle of the gun after the cartridge case flange has engaged the face of the breech block until the momentum of said sliding mass has been dissipated in said shock absorber whereby the mass, velocity and rebound characteristics of a live round are simulated.

2. An inert dummy cartridge as defined in claim 1 wherein said shock absorber is adjustable to accommodate different ramming velocities in different gun mounts.

3. An inert dummy cartridge as defined in claim 1 wherein a compression spring is interposed between said sliding mass and said shock absorber for returning said sliding mass to its starting position at the completion of the ramming cycle.

4. An inert dummy cartridge as defined in claim 1 wherein said shock absorber is hydraulic and the momentum of said sliding mass is dissipated in the form of heat.

5. An inert dummy cartridge as defined in claim 2 wherein a compression spring is interposed between said sliding mass and said shock absorber for returning said sliding mass to its starting position at the completion of the ramming cycle.

6. An inert dummy cartridge as defined in claim 2 wherein said shock absorber is hydraulic and the momentum of said sliding mass is dissipated in the form of heat.

7. An inert dummy cartridge as defined in claim 5 wherein said shock absorber is hydraulic and the momentum of said sliding mass is dissipated in the form of heat.

* * * * *